United States Patent [19]

West

[11] Patent Number: 4,522,241

[45] Date of Patent: Jun. 11, 1985

[54] LOG SPLITTER

[75] Inventor: Gene P. West, Grass Valley, Calif.

[73] Assignee: Gene West, Inc., Nevada City, Calif.

[21] Appl. No.: 520,654

[22] Filed: Aug. 5, 1983

[51] Int. Cl.[3] ..... B27L 7/00

[52] U.S. Cl. ..... 144/193 A; 144/366

[58] Field of Search ..... 144/193 R, 193 A, 366

[56] References Cited

U.S. PATENT DOCUMENTS

| | | | |
|---|---|---|---|
| 3,938,567 | 2/1976 | Dircksen et al. | 144/193 A |
| 3,974,867 | 8/1976 | Butas, Jr. | 144/193 A |
| 4,076,061 | 2/1978 | Greeninger | 144/3 K |
| 4,103,724 | 8/1978 | Braid | 144/193 A |
| 4,128,117 | 12/1978 | Terry et al. | 144/3 K |
| 4,141,396 | 2/1979 | McCallister | 144/193 A |
| 4,157,105 | 6/1979 | Gansley | 144/193 A |
| 4,160,470 | 7/1979 | Sigmund | 144/3 B |
| 4,275,778 | 6/1981 | Kotas | 144/193 A |
| 4,310,039 | 1/1982 | O'Brien | 144/193 A |
| 4,351,377 | 9/1982 | Hamel | 144/193 A |

FOREIGN PATENT DOCUMENTS

| | | | |
|---|---|---|---|
| 697327 | 11/1970 | U.S.S.R. | 144/193 P |

*Primary Examiner*—W. D. Bray

*Attorney, Agent, or Firm*—Townsend and Townsend

[57] ABSTRACT

A log splitter includes a main frame supporting a movable push block which forces logs supported within a log trough against a splitting wedge. A splitting wedge is movably mounted to the frame for movement towards and away from the push block. A hydraulic ram is connected to the movable wedge through a roller support box to allow the splitting wedge to be driven toward the push block to aid splitting difficult logs. A downwardly and outwardly extending bark ramp is mounted at the leading edge of the splitting wedge to direct bark and other debris up the bark ramp and out of the log trough as the log is forced through the log trough by the push block.

6 Claims, 7 Drawing Figures

LOG SPLITTER

BACKGROUND OF THE INVENTION

Log splitters are in widespread use for splitting logs for one's fireplace. Log splitters generally use a movable ram to force a log lengthwise against a stationary splitting wedge. In addition to splitting logs for fireplace use, commercial log splitters are also used to split logs prior to feeding them through a wood chipper. Although these log splitters are usually quite large, their general construction is similar to the smaller splitters used to split fireplace wood.

Most logs split into two pieces after about one quarter of their length has been driven past the leading edge of the splitting wedge. However, some logs are quite tough and difficult to split so that a substantial portion of the log must be forced past the splitting wedge to assure a complete split. Therefore the ram driving the push block must be capable of driving the push block substantially the entire distance between the retracted position of the push block and the leading edge of the splitting wedge. Because of this, the length of the conventional, hydraulically actuated log splitters is at least double the maximum length of the log accommodated. Increasing the usable log length in conventional log splitters increases the length of the hydraulic ram and cylinder powering the push block. Increasing the ram length, because of the tendency of columns (such as a ram) to buckle when axially loaded, dictates the use of a substantially stronger ram. Thus this added ram length can disproportionately increase the cost of an extended length log splitter.

SUMMARY OF THE INVENTION

The present invention allows extended length logs to be split without the need for an excessively long ram. The log splitter includes a main frame supporting a movable push block. Logs are supported within a log trough in the main frame and are driven against a splitting wedge by the push block. The log trough is divided into main and secondary sections. The main section extends substantially along the entire path of the push block from its retracted to its extended positions.

The splitting wedge is mounted to the frame for movement towards and away from the push block along the secondary trough section. During normal operations, the movable wedge is mounted at a set position along the secondary log trough section. The location chosen depends upon the maximum length of the logs to be split. When a difficult to split log is encountered, the splitting wedge can be driven toward the push block to aid splitting the log.

The main frame includes a frame member having an I-beam cross-sectional shape mounted beneath the log trough. The splitting wedge is mounted to a roller support box. The roller support box includes a number of rollers engaging various surfaces of the I-beam frame member. The rollers transmit the log splitting forces from the splitting wedge to the I-beam frame member. The splitting wedge is typically driven by a hydraulic ram connected to the roller support box.

A bark ramp extends outwardly and downwardly from the leading edge of the splitting wedge. The ramp is used to direct bark and other debris out of the primary log trough section during movement of a log through the log trough. This keeps such debris from compacting against the base of the splitting wedge.

A primary feature of the invention is the provision of a splitting wedge which can be left in a stationary position during normal operation and can be driven towards the push block when a difficult to split log is encountered. When the splitting wedge is positioned distant from the fully extended position of the push block, logs of much greater length can be split without increasing the length of the push block drive cylinder and ram. Therefore the overall length of the log splitter can be less than would be required to split the same length log with log splitter using a stationary splitting wedge and a conventional push block-drive cylinder-ram combination.

In a preferred embodiment the splitting wedge is powered by a hydraulic piston-cylinder drive mounted beneath the log trough. When extended length logs are being split, the splitting wedge rests against a wedge stop at a far end of the log splitter. When a difficult to split log is encountered, the splitting wedge hydraulic drive is actuated pulling the splitting wedge towards the push block to finish splitting the log.

Since the log splitter of the invention uses two hydraulic rams instead of one, the maximum ram length is shorter than would otherwise be required for splitting a log of the maximum length. This reduces the strength, and thus the cost, required for the ram. Therefore, even though two ram assemblies are required, the cost for a log splitter may be less compared with the cost for conventional log splitter using only a single ram assembly.

Positioning the splitting wedge driving member beneath the log trough serves dual functions. First, the splitting wedge cylinder and ram do not increase the length of the log splitter. This lowers the cost and increases the mobility of the log splitter. Second, placed beneath the log trough they are protected against damage by the split logs.

Other features and advantages of the present invention will appear from the following description in which the preferred embodiment has been set fourth in detail in conjunction with the accompanying drawings.

DETAILED DESCRIPTION OF THE PREFERRED EMBODIMENT

Figure 1:
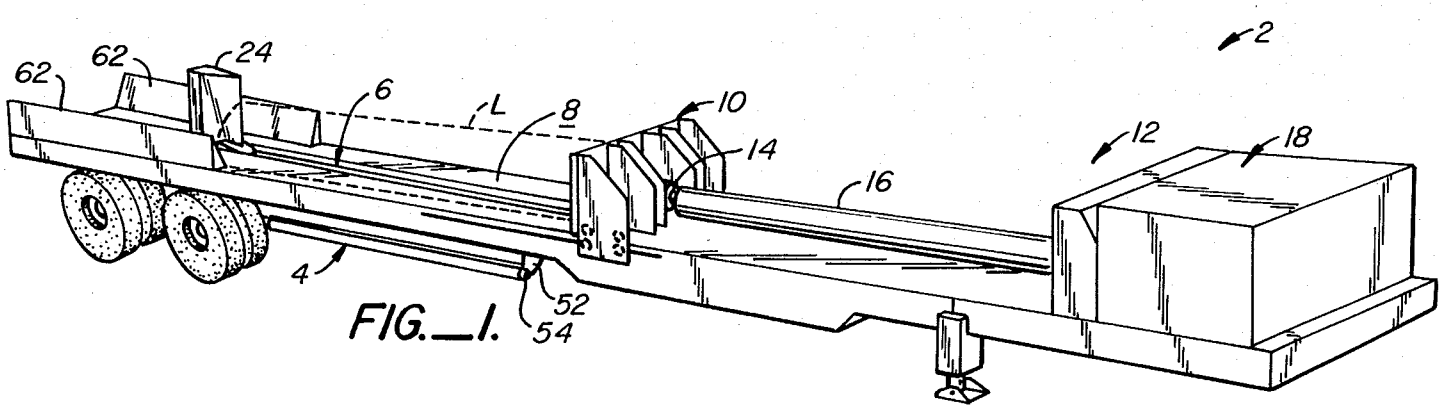
FIG. 1 is a perspective view of the log splitter of the invention.
Figure 2:
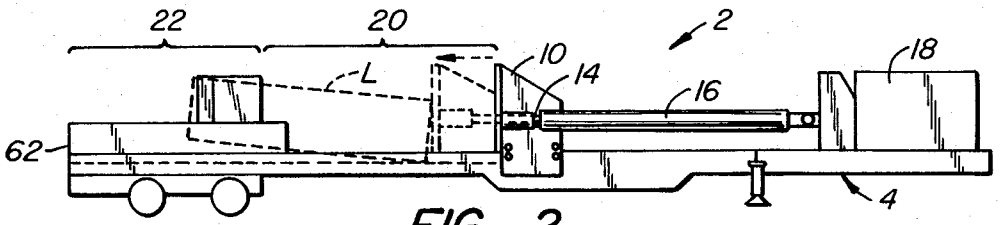
FIG. 2 is a side view of the log splitter of FIG. 1 with extension of the push block indicated by dashed lines.

Referring now to FIGS. 1 and 2, log splitter 2 includes generally an elongate frame 4 which defines a elongate log trough 6 along its upper surface 8 for supporting a log L therein. A push block 10 is mounted for movement along upper surface 8 and is driven by a push block drive 12. Drive 12 includes the push block ram 14, a push block cylinder 16 and a hydraulic power source 18.

Figure 4:
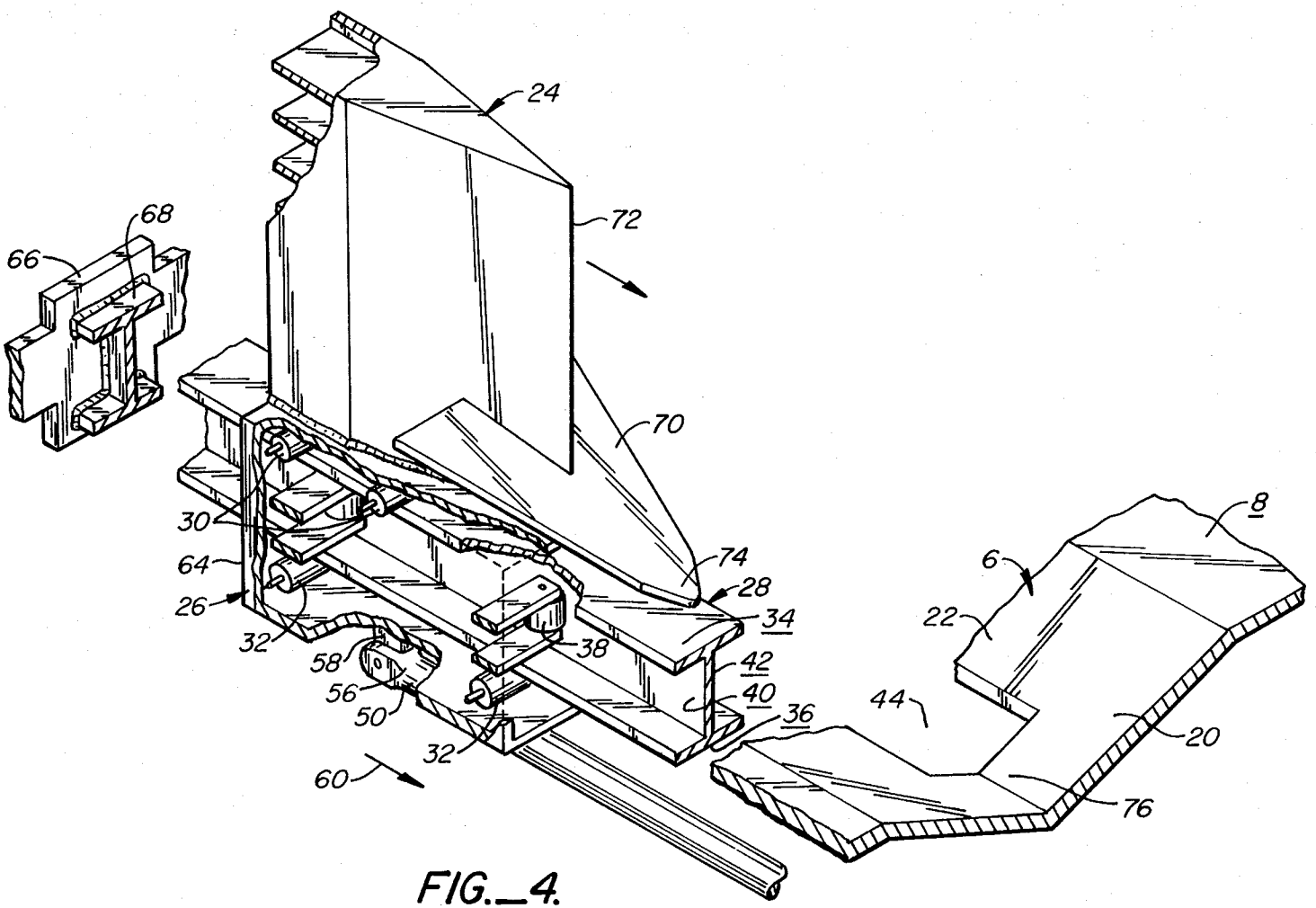
FIG. 4 is an enlarged isometric view of the movable splitting wedge and portions of the log trough and I-beam support member.

Log trough 6 includes a primary section 20 and a secondary section 22. A splitting wedge 24 is mounted to frame 4 for movement along secondary section 22 of log trough 6 as shown in FIG. 4. Splitting wedge 24 is mounted directly to a rectangular roller support box 26, which surrounds an I-beam support member 28 of frame 4. Support box 26 includes a pair of upper rollers 30 and a pair of lower rollers 32 which ride along the upper and lower horizontal surfaces 34, 36 of member 28. Lateral positioning is provided by two pairs of vertically disposed side rollers 38 which engage the vertical web surfaces 40, 42 of member 28.

Figure 5:
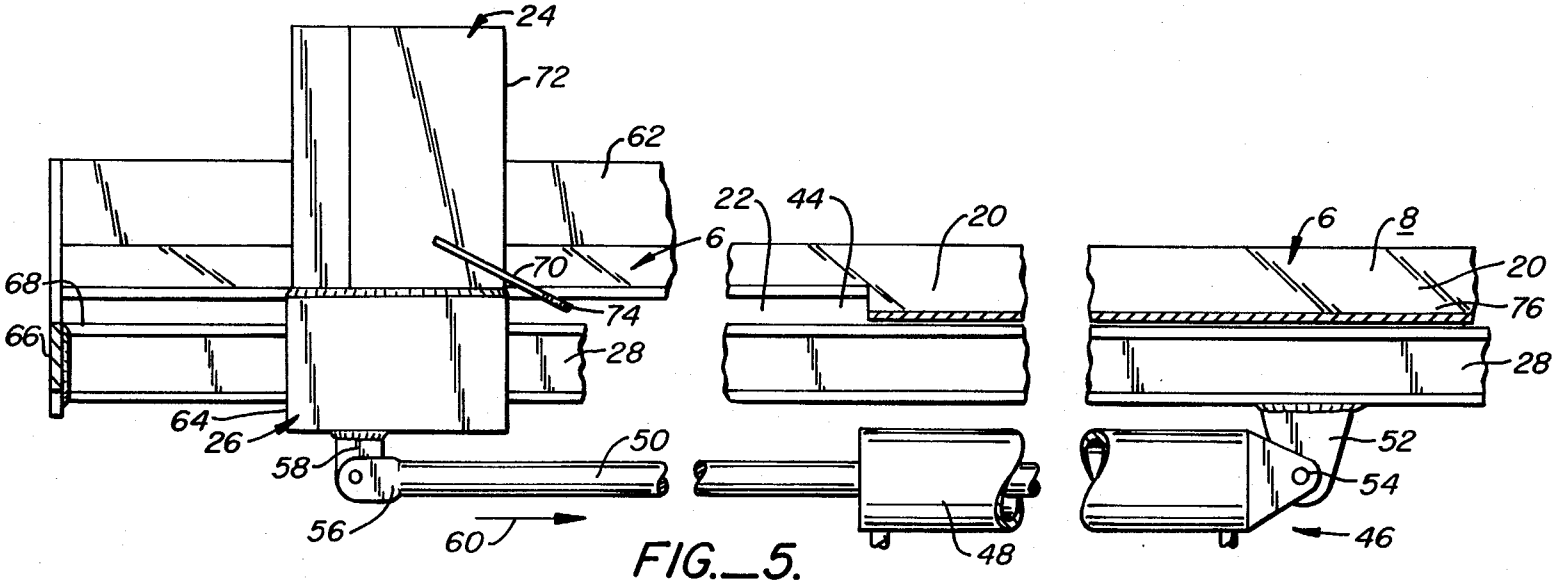
FIG. 5 is a simplified longitudinal cross-sectional view of the log splitter of FIG. 3C.

Secondary section of 22 of log trough 6 includes an opening 44 which allows splitting wedge 24 to extend through upper surface 8 of frame 4. Moveable splitting wedge 24 is positioned by a splitting wedge drive 46. Drive 46 includes a hydraulic cylinder 48 and its associated hydraulic ram 50 mounted beneath I-beam support member 28 as shown in FIG. 5. One end of cylinder 48 is mounted directly to member 28 by a lug 52 at a pivot 54. The outer end 56 of ram 50 is pivotally connected to the bottom of roller support box 28 by a connecting lug 58. Splitting wedge drive 46 is also powered by power source 18.

When splitting shorter length logs, splitting wedge 24 is positoned toward push block 10 by retraction of ram 50 in the direction of arrow 60 of FIG. 5. This position is shown in FIGS. 1 and 2. During these operations, logs are split by the movement of push block 10 towards a stationary splitting wedge 24. The split log sections fall on either side of splitting wedge 24, but are restrained from falling off the sides of upper surface 8 by a pair of upwardly extending angled sides 62. Subsequent logs push the previously split sections off the end of log splitter 2 where they can be left in a pile on the ground or immediately transferred for further processing, such as to a chipper.

A downwardly and outwardly sloping bark ramp 70 is mounted to the leading edge 72 splitting wedge 24. Ramp 70 is positioned so that when splitting wedge 24 is in the position of FIG. 2, the distal end of 74 bark ramp 70 lies adjacent the bottom of one end 76 of primary section 20 of log trough 6. Log ramp causes bark and other debris within log trough 6 to be pushed up and out away from splitting wedge 24 by movement of log L through log trough 6.

Figure 3A:
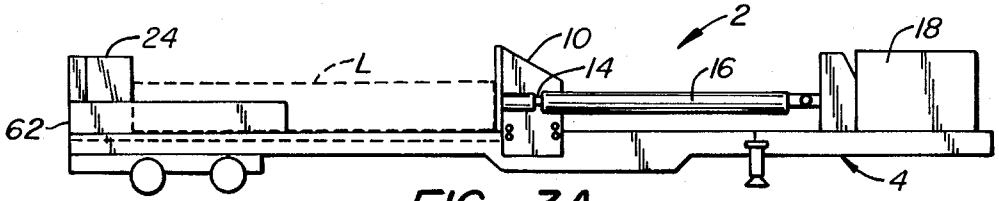
FIG. 3A show the log splitter of FIG. 1 with the splitting block positioned for splitting an extended length log.
Figure 3B:
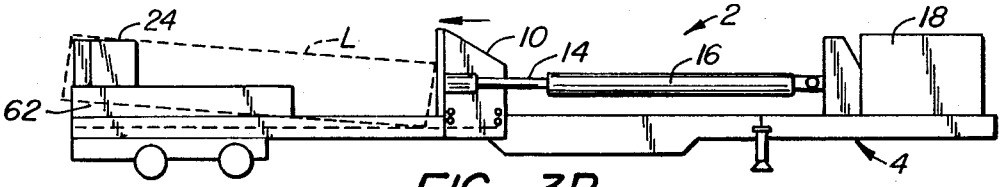
FIG. 3B shows the log splitter of FIG. 3A with the push block in a partially extended position beginning to split the log.
Figure 3C:
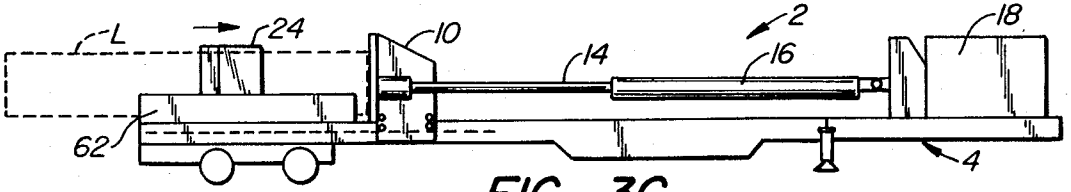
FIG. 3C shows the push block at its fully extended position and movement of the splitting wedge toward the push block to finish splitting the log.

When extended length logs are to be split, splitting wedge 24 is positioned at its rearward most location along secondary section 22 of trough 6 by extending splitting wedge ram 50. The rear edge 54 of box 26 rests against a plate 66 surrounding the far end 68 of I-beam member 28. This position is shown in FIG. 3A which also shows a log L placed between a fully retracted push block 10 and splitting wedge 24. Movement of push block 10 toward splitting wedge 24, as shown in FIG. 3B, drives log L against splitting wedge 24 causing it to split. Typically logs split after only a fraction of their length has been driven past the splitting wedge. Thus, normally during splitting operations, only push block 10 and not splitting wedge 24 move. However, some logs are difficult to split so that even after push block 10 is fully extended, as shown in FIG. 3C, the log has not split completely. As in this case, splitting wedge drive 46 can be actuated to pull splitting wedge 24 towards push block 10 to complete the split. This is shown in FIG. 3C.

In the disclosed embodiment, splitting wedge drive 46 is sufficiently powerful to resist the force of push block 10 when in its forward position shown in FIG. 2 and also to drive splitting wedge 24 towards push block 10 as shown in FIG. 3C. If desired, a mechanical stop can be provided to lock splitting wedge 24 in its position of FIG. 2 or any intermediate position along secondary section 22. To completely split difficult logs, instead of driving splitting wedge 24 towards a stationary push block 10, one could retract push block 10 and then drive splitting wedge 24 and the partially split log therewith towards the retracted push block until the splitting block can be locked into a forward (towards push block 10) position. At that point, push block 10 can be reactuated to complete the log split. In this event, it may be desired to use means other than hydraulic cylinder 48 and ram 50 to drive splitting wedge 24 along secondary section 22 of trough 6.

Modification and variation can be made to the disclosed embodiment without departing from the subject invention as defined in the following claims. For example, instead of downwardly sloping log trough 6, logs can be positioned on upper surface 8 of frame 4 using members extending upwardly from surface 8.

I claim:

1. A log splitter comprising:

a frame having an upper log supporting surface and an I-beam support member, said log supporting surface having elongate first and second portions, said second portion having an opening extending along the length thereof;

a push block;

means for driving said push block along said first portion of said log supporting surface;

a splitting wedge extending through said opening in said second portion;

means for movably mounting said splitting wedge to said I-beam support member for movement along said second portion;

means for selectively driving said push block towards said splitting wedge and means for selectively driving said splitting wedge toward said push block, to split a log supported by said support surface between said wedge and said push block; and a bark ramp extending from a forward edge of the splitting wedge downwardly toward the support surface and outwardly away from the splitting wedge with a distal end of said ramp being generally level with a central portion of said support surface so debris pushed by log toward said splitting wedge is diverted up and away from said splitting wedge by said bark ramp.

2. The log splitter of claim 1 wherein:

said I-beam support member includes upper and lower generally horizontal members, having upper and lower outwardly extending surfaces, and a generally vertical web member having first and second generally vertical web surfaces; and wherein said splitting wedge movably mounting means includes:

a roller support frame circumscribing said I-beam support member;

upper and lower rollers, rotatably mounted to said roller support frame, rollably engaging the upper and lower surfaces of said I-beam support member; and first and second rollers, rotatably mounted to said roller support frame, rollably engaging said first and second web surfaces;

whereby said upper, lower, first and second rollers supportably guide said splitting wedge for movement along said I-beam support member.

3. The log splitter of claim 2 wherein said splitting wedge movably mounting means includes a plurality of each of said first and second rollers.

4. The log splitter of claim 2 wherein said splitting wedge movably mounting means includes a plurality of each of said upper, lower, first and second rollers.

5. The log splitter of claim 2 wherein said roller support frame is a roller support box having a rectangular cross-sectional shape with open ends, solid sides, a solid top and a solid bottom, said splitting wedge being secured directly to said solid top.

6. A log splitter comprising:

a frame having an upper log supporting surface and an I-beam support member, said log supporting surface having elongate first and second portions, said second portion having an opening extending along the length thereof;

said I-beam support member including upper and lower generally horizontal members, having upper and lower outwardly extending surfaces, and a generally vertical web member having first and second generally vertical web surfaces;

a push block;

means for driving said push block along said first portion of said log supporting surface;

a splitting wedge extending through said opening in said second portion;

means for movably mounting said splitting wedge to said I-beam support member for movement along said second portion including:

a roller support frame circumscribing said I-beam support member;

upper and lower rollers, rotatably mounted to said roller support frame, rollably engaging the upper and lower surfaces of said I-beam support member; and first and second rollers, rotatably mounted to said roller support frame, rollably engaging said first and second web surfaces;

whereby said upper, lower, first and second rollers supportably guide said splitting wedge for movement along said I-beam support member; and means for selectively driving said push block towards said splitting wedge and means for selectively driving said splitting wedge toward said push block, to split a log supported by said support surface between said wedge and said push block.

* * * * *